US005929559A

United States Patent [19]

Sano et al.

[11] Patent Number: 5,929,559

[45] Date of Patent: Jul. 27, 1999

[54] CATHODE RAY TUBE

[75] Inventors: Yuuichi Sano, Fukaya; Masahiro Yokota, Kumagaya; Tadahiro Kojima, Fukaya, all of Japan; Eiji Kamohara, Horseheads, N.Y.

[73] Assignee: Kabushiki Kaisha Toshiba, Kawasaki, Japan

[21] Appl. No.: 08/941,075

[22] Filed: Sep. 30, 1997

[30] Foreign Application Priority Data

Sep. 30, 1996 [JP] Japan ..... 8-259103

[51] Int. Cl.[6] ..... H01J 31/00

[52] U.S. Cl. ..... 313/477 R; 313/440; 220/2.1 A

[58] Field of Search ..... 313/440, 413, 313/403, 434, 477 R; 220/2.1, 2.1 A

[56] References Cited

U.S. PATENT DOCUMENTS 3,731,129 5/1973 Tsuneta et al. .
5,099,169 3/1992 Vriens ..... 313/403
5,155,411 10/1992 Swank et al. ..... 313/477
5,258,688 11/1993 Fondrk .
5,610,473 3/1997 Yokota et al. ..... 313/402
5,760,539 6/1998 Park ..... 313/461

FOREIGN PATENT DOCUMENTS 2 033 159 11/1970 France .

*Primary Examiner*—Sandra O'Shea
*Assistant Examiner*—Michael J. Smith
*Attorney, Agent, or Firm*—Pillsbury Madison & Sutro

[57] ABSTRACT

A funnel of a cathode ray tube includes a yoke attachment portion on which a deflection yoke is mounted so as to deflect the electron beam emitted from an electron gun along horizontal and vertical axis. At least one cross section of the yoke attachment portion, perpendicular to the tube axis, has an inner contour which is substantially rectangular with four sides. The sides are defined by convexities curved toward the tube axis and each having a peak on the horizontal or vertical axis. The inner contour of the cross section faces the electron beam passage region with a substantially constant gap.

6 Claims, 4 Drawing Sheets

CATHODE RAY TUBE

BACKGROUND OF THE INVENTION

The present invention relates to a cathode ray tube, such as a color image receiving tube.

For example, a color cathode ray tube generally comprises a vacuum envelope which includes a glass face panel having a substantially rectangular display portion, a glass funnel connected to the face panel, and a cylindrical glass neck connected to the funnel. An electronic gun for emitting three electron beams is arranged within the neck. A deflection yoke is fitted on the periphery of the neck and the periphery of a part of the funnel. The funnel has a small-diameter portion, a so-called yoke attachment portion, which extends from a joint between the funnel and the neck to a portion where an end of the deflection yoke is located.

A phosphor screen is formed on the inner surface of the face panel. The screen comprises three-color phosphor dotted or stripe layers which emit blue, green and red light, respectively. Within the vacuum envelope, a shadow mask having a number of electron beam passage apertures faces the phosphor screen.

The electron beams emitted from the electron gun are deflected in horizontal and vertical directions by horizontal and vertical deflection magnetic fields generated by the deflection yoke, so that the phosphor screen is scanned by the electron beams horizontally and vertically through the shadow mask, thereby displaying color images.

As a type of the cathode ray tubes, a color cathode ray tube of self-convergence in-line type has been widely put into practical use. The cathode ray tube of this type has an in-line electron gun, which emits three electron beams arranged in line on the same horizontal plane. The three electron beams emitted from the electron gun are deflected by a horizontal deflection magnetic field, shaped like a pin cushion, and a vertical deflection magnetic field, shaped like a barrel. Thus, the three electron beams in line are converged at a point in any portion of the screen without using special correcting means.

In the cathode ray tube as described above, the deflection yoke consumes a great amount of power. To reduce the power consumption of the cathode ray tube, therefore, it is important to reduce the power consumption of the deflection yoke. The deflection power is increased in the following situations: when the cathode voltage for accelerating the electron beams is increased to increase the screen luminance at last; and when the deflection frequency is increased to use the cathode ray tube in OA equipment, e.g., an HD (High Definition) device or PC (Personal Computer).

Regarding a type of the OA equipment, such as a PC, which is operated by the operator being close to the cathode ray tube, control over leakage magnetic field (magnetic-field leaked from the deflection yoke to the outside of the cathode ray tube) has been tightened. Conventionally, to reduce the leakage magnetic field, a compensation coil is added to the cathode ray tube. However, when the compensation coil is added, the power consumption of the PC is increased accordingly.

In general, to reduce the deflection power and the leakage magnetic field, it is preferable to decrease the diameter of the neck of the cathode ray tube and the outer diameter of the yoke attachment portion of the funnel, to which the deflection yoke is attached, so that the interaction space of the deflection magnetic field can be reduced and the deflection magnetic field can efficiently be exerted on the electron beams.

However, in the cathode ray tube, the electron beams pass near the inner surface of the yoke attachment portion of the funnel. Therefore, if the neck diameter or the diameter of the yoke attachment portion is reduced, the electron beams directed to the corner portions of the phosphor screen at the maximum deflection angle will collide against the inner surface of the yoke attachment portion. As a result, the electron beams cannot be applied to some portions of the phosphor screen. Therefore, in the conventional cathode ray tube, it is difficult to sufficiently reduce the neck diameter and the outer diameter of the yoke attachment portion in order to reduce the deflection power.

Further, if the electron beams continuously collide against the inner surface of the yoke attachment portion of the funnel, the temperature of that portion rises so high that the glass forming the funnel will be melted. In this case, the vacuum envelope may be imploded.

Jpn. Pat. Appln. KOKOKU Publication No. 48-34349 (corresponding to U.S. Pat. No. 3,731,129) discloses means for solving the above problems. According to the disclosure of the publication, the yoke attachment portion of the funnel to which the deflection yoke is attached has a substantially pyramidal shape. In other words, the cross section of the yoke attachment portion of the funnel is gradually changed from a circle to a rectangle from the neck toward the face panel. This structure is based on the idea that the electron beams pass a substantially rectangular region inside the yoke attachment portion, when drawing a rectangular raster on the phosphor screen.

If the yoke attachment portion of the funnel is shaped like a pyramid, the diameters of the portion along the major axis (horizontal axis: H axis) and the minor axis (vertical axis: V axis) can be reduced. For this reason, the horizontal and vertical deflection coils of the deflection yoke can be close to the electron beams, thereby efficiently deflecting the beams. As a result, the deflection power can be saved.

However, as the cross section of the yoke attachment portion of the funnel becomes nearly rectangular to effectively reduce the deflection power as described above, side end portions of the yoke attachment portion along the horizontal and vertical axes become flat. Therefore, the side end portions are distorted toward the axis of the tube by the load of the atmospheric pressure. As a result, compressive stress $\sigma H$ and $\sigma V$ are generated on the outer surface of the yoke attachment portion near the side end portions along the horizontal and vertical axes, and great tensile stress $\sigma O$ is generated on the outer surface of the yoke attachment portion near the ends of the diagonal axes. Thus, the strength against the atmospheric pressure of the vacuum envelope is reduced and the safety is impaired.

Further, at present, there is a great demand for prevention of a reflection of external light on the face panel and high visibility of an image. For this purpose, it is necessary that the face panel be flat. However, if the face panel is flat, the strength of the vacuum envelope is reduced. Therefore, when the conventional funnel having a pyramidal yoke attachment portion is used, it is difficult to maintain the strength of the panel necessary for safety.

For the reasons stated above, the conventional cathode ray tube has problem that the yoke attachment portion of the funnel cannot be so rectangular as to sufficiently reduce the deflection power or that the rectangular yoke attachment portion cannot be applied to a flat face panel. Therefore, according to the conventional art, although the yoke attachment portion of the funnel can be shaped like a pyramid, it cannot reduce the deflection power while maintaining sufficient strength against the atmospheric pressure.

BRIEF SUMMARY OF THE INVENTION

The present invention was made to solve the above problems, and its object is to provide a cathode ray tube which satisfies the demands for high luminance and high-frequency deflection, by effectively reducing the deflection power, while maintaining sufficient strength against the atmospheric pressure of the vacuum envelope.

To achieve the above object, according to the present invention, there is provided a cathode ray tube comprising:

a vacuum envelope comprising: a face panel including a substantially rectangular effective portion having horizontal and vertical axes which cross at right angles and pass a tube axis, a funnel connected to the face panel; a cylindrical neck connected to a smaller-diameter end of the funnel; and a phosphor screen formed on an inner surface of the effective portion of the face panel, the funnel including a yoke attachment portion extending from the smaller-diameter end connected to the neck toward the face panel;

an electron gun arranged within the neck, for emitting an electron beam to the phosphor screen; and a deflection yoke fitted on outer surfaces of the neck and the yoke attachment portion of the funnel, for deflecting the electron beam emitted from the electron gun along the horizontal and vertical axes so as to scan the phosphor screen by the electron beam.

An outer contour of at least one cross section of the yoke attachment portion, perpendicular to the tube axis, is a non-circle in which a distance between the tube axis and the outer contour is at a maximum at a point on a first contour line segment obtained by excluding a first intersection of the horizontal axis and the outer contour and a second intersection of the vertical axis and the outer contour from a second contour line segment extending between the first and second intersections; and on the at least one cross section, assuming that an intersection of the inner contour of the cross section and a line passing through the tube axis and forming an angle ($\theta$) with the horizontal axis is represented by Pi($\theta$), a shortest distance between Pi($\theta$) and the horizontal axis is represented by Piv($\theta$) and a shortest distance between Pi($\theta$) and the vertical axis is represented by Pih($\theta$), the inner contour of the cross section has a shape such that Piv($\theta$) or Pih ($\theta$) is expressed by a non-monotone increasing or decreasing function which has a maximum value [$dPiv(\theta_0)/d\theta=0$) or $dPih(\theta_0)/d\theta=0$] at an angle ($\theta_0$), when the angle ($\theta$) is varied in a range of $0<\theta<90$.

Further, according to the cathode ray tube of the present invention, at least one cross section of the yoke attachment portion, perpendicular to the tube axis, has a substantially rectangular outer contour having a pair of first opposed sides with the horizontal axis interposed therebetween and a pair of second opposed sides with the vertical axis interposed therebetween and a substantially rectangular inner contour having a pair of third opposed sides with the horizontal axis interposed therebetween and a pair of fourth opposed sides with the vertical axis interposed therebetween; and at least a part of each side of the inner contour of the at least one cross section is defined by a convexity curved toward the tube axis.

In the cathode ray tube, each of the sides of the inner contour is entirely defined by convexities curved toward the tube axis.

In the cathode ray tube, each of the sides of the inner contour is defined by convexities curved toward the tube axis and having a peak on the horizontal or vertical axis.

According to the cathode ray tube as described above, because of the aforementioned shape of the yoke attachment portion of the funnel, the glass in the yoke attachment portion has a sufficient thickness to improve the strength of the yoke attachment portion and the vacuum envelope. Therefore, a substantially pyramidal yoke attachment portion can be used, so that the deflection power can be effectively reduced, whereby the demand for high luminance and high-frequency deflection can be satisfied.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

FIGS. 1 to 7 show a color cathode ray tube according to an embodiment of the present invention, in which:

FIG. 1 is a perspective view from the back side of the color cathode ray tube, FIG. 2 is a cross-sectional view taken along the tube axis of the color cathode ray tube, FIG. 3 is a perspective view schematically showing the electron gun, the phosphor screen and the shadow mask of the color cathode ray tube, FIG. 4 is a cross-sectional view taken along the line III—III in FIG. 1, FIG. 5 is a cross-sectional view taken along the line IV—IV in FIG. 1, FIG. 6 is a cross-sectional view taken along the line V—V in FIG. 1, and FIG. 7 is a cross-sectional view corresponding to FIG. 6 for explaining the shape of the inner and outer surfaces of the yoke attachment portion of the color cathode ray tube;

DETAILED DESCRIPTION OF THE INVENTION

A color cathode ray tube according to an embodiment of the present invention will be described in detail with reference to the accompanying drawings.

Figure 1:
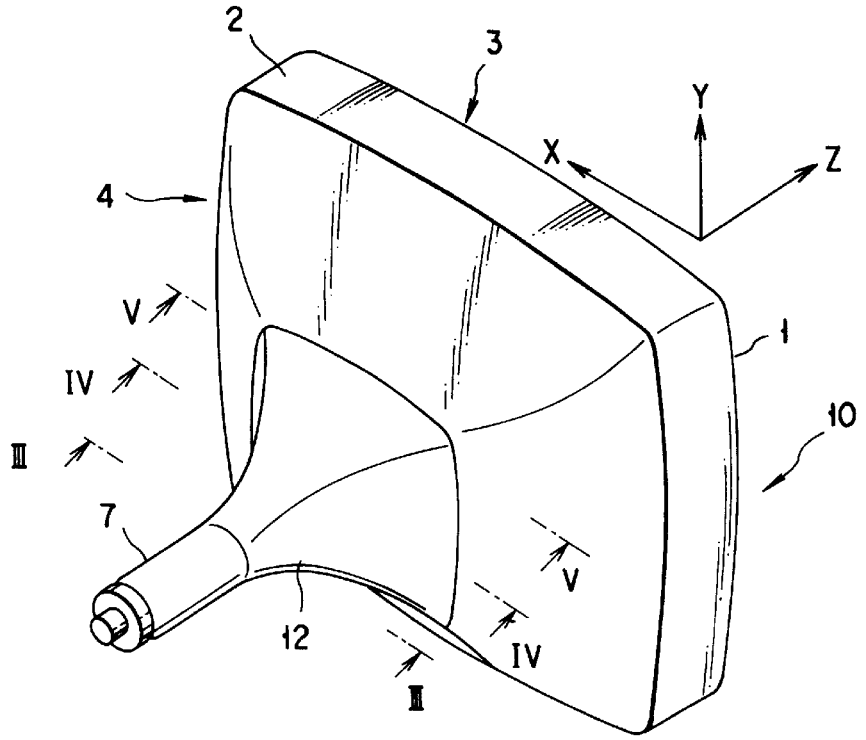
Figure 2:
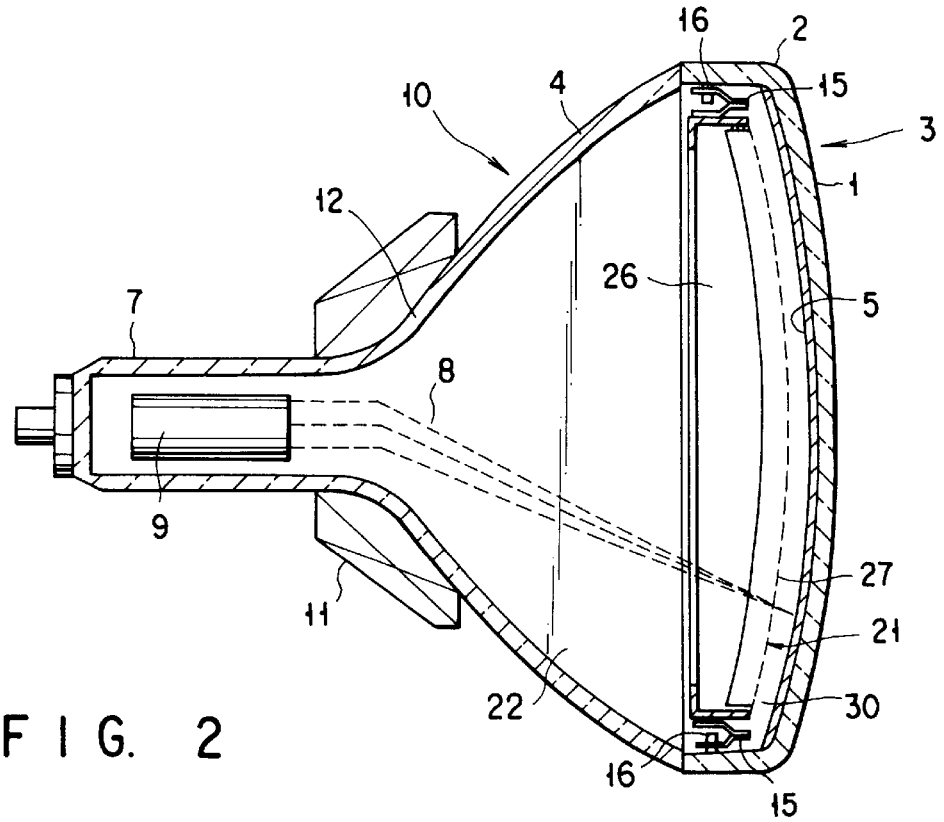
Figure 3:
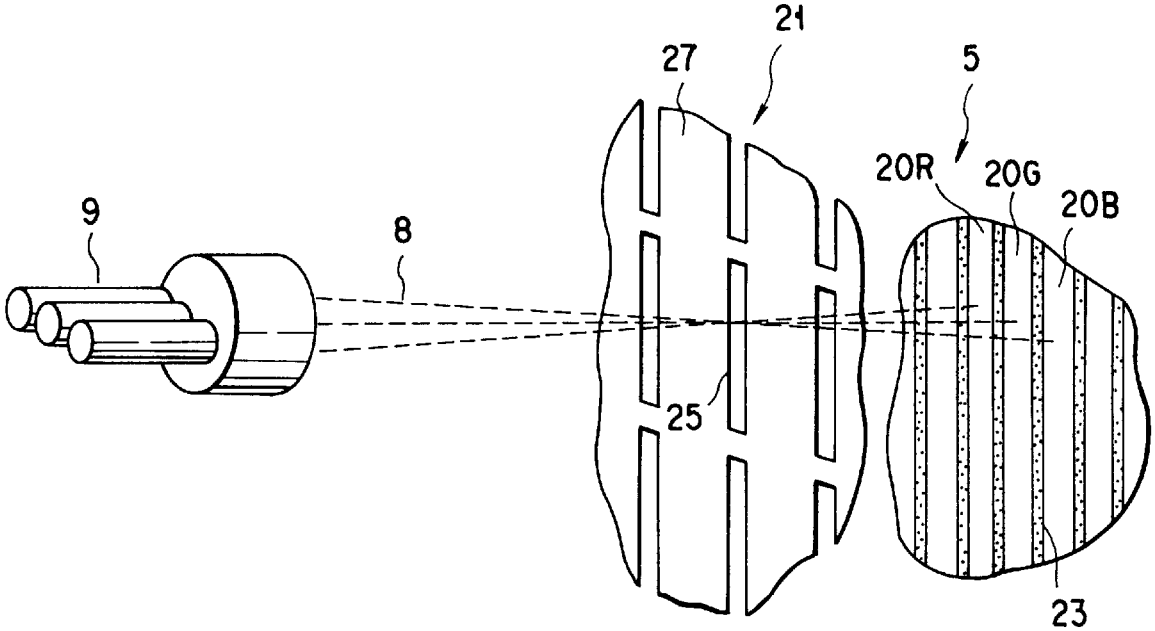

As shown in FIGS. 1 to 3, a color cathode ray tube comprises a vacuum envelope 10 made of glass. The vacuum envelope 10 is constituted by a face panel 3 having a substantially rectangular effective portion 1 and a skirt portion 2 formed on the periphery of the effective portion, a funnel 4 connected to the skirt portion 2, and a cylindrical neck 7 extending from the funnel. The effective portion 1 of the face panel 3 is substantially shaped as a rectangle, which has a horizontal axis X and a vertical axis Y crossing at right angles through a tube axis Z of the cathode ray tube. The funnel 4 has a yoke attachment portion 12, on the outside of which a deflection yoke 11 is mounted.

A phosphor screen 5 is formed on the inner surface of the effective portion of the panel 3. The phosphor screen 5 has three-color stripe phosphor layers 20B, 20G and 20R which respectively emit blue, green and red light, and stripe light shielding layers 23 formed between adjacent phosphor layers. In the vacuum envelope 10, a shadow mask 21 is arranged so as to face the phosphor screen 5. The shadow mask 21 has a mask main body 27 having a number of electron beam passage apertures 25 and a mask frame 26 supporting the periphery of the mask main body. Substantially wedge-shaped elastic supporting members 15, fixed to corner portions of the mask frame 26, are respectively engaged with stud pins 16 projecting from the inner surface of the skirt portion 2 of the face panel 3, with the result that the shadow mask 21 is supported by the face panel 3.

An electron gun 9 for emitting three electron beams 8 is mounted in the neck 7. The three electron beams 8 emitted from the electron gun 9 are deflected in horizontal and vertical directions by horizontal and vertical deflection magnetic fields generated by the deflection yoke 11, so that the phosphor screen 5 is scanned horizontally and vertically through the shadow mask 21, thereby displaying color images.

Figure 4:
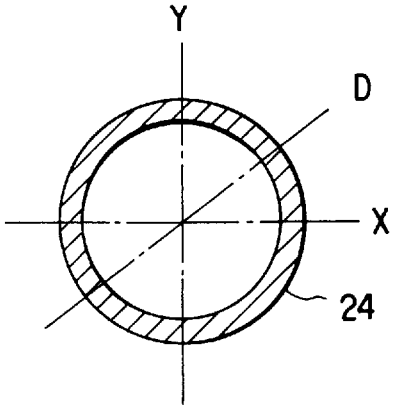

In this embodiment, the yoke attachment portion 12 to which the deflection yoke 11 is attached is substantially pyramidal. In detail, the cross section of the yoke attachment portion 12, which is perpendicular to the tube axis and located neat the joint between the neck 7 and the funnel 4, is circular like the neck as shown in FIG. 4, but the cross sections of the yoke attachment portion at an intermediate between the two axial ends of the yoke attachment portion and at the axial end thereof on the phosphor screen side are substantially rectangular in correspondence with the shape of the effective portion 1 of the face panel 3, as shown in FIGS. 5 and 6.

Figure 6:
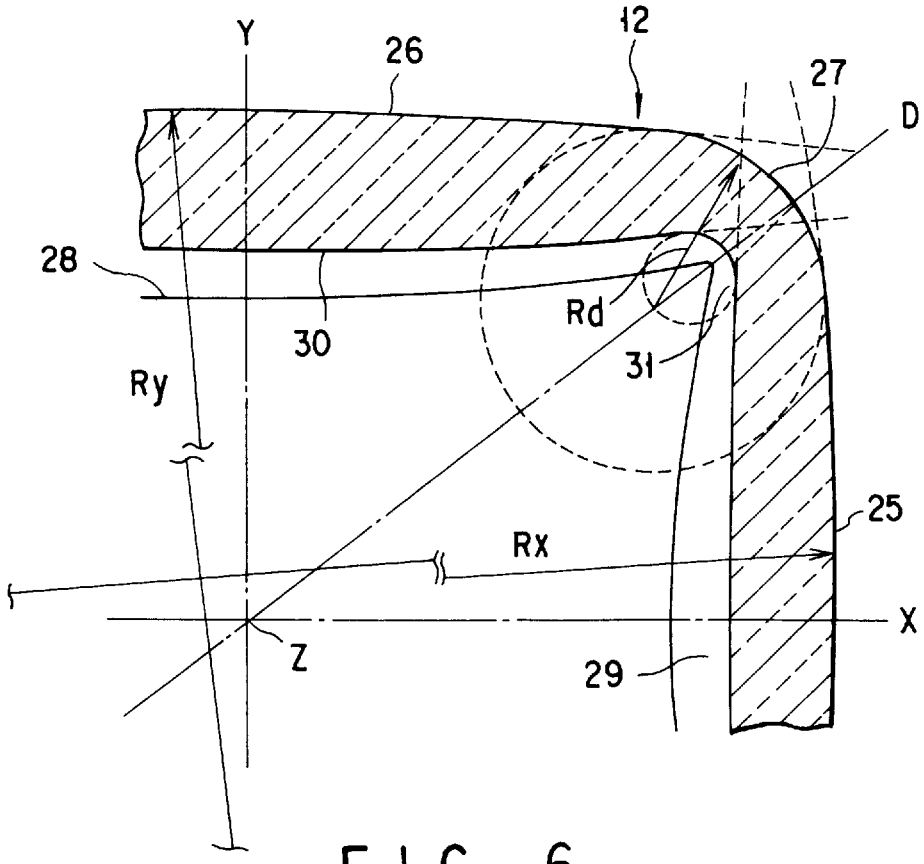

In a portion of the yoke attachment portion 12 having a substantially rectangular cross section, as shown in FIG. 6, assuming that the face panel effective portion 1 has a horizontal axis X, a vertical axis Y and a diagonal axis D respectively extending in the horizontal, vertical and diagonal directions, the outer contour of the cross section has a pair of arc segments 25 of radius Rx whose centers are located on the horizontal axis X, a pair of arc segments 26 of radius Ry whose centers are located on the vertical axis Y, and arcs 27 of radius Rd whose centers are located on the diagonal axis D near a corner. The substantially rectangular shape can be defined by another expression, for example, various formulas.

Figure 5:
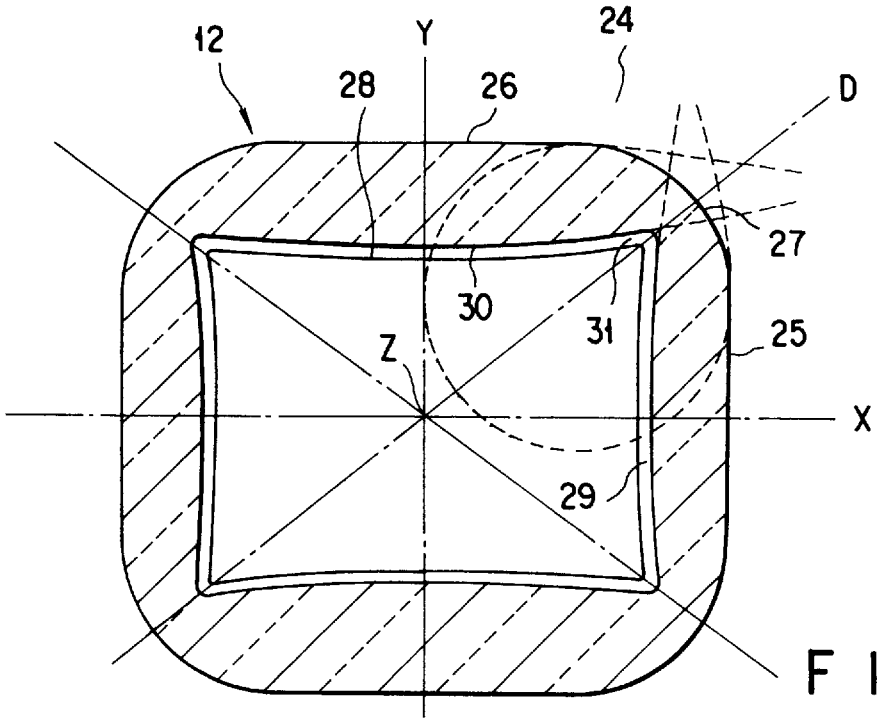

In contrast, as shown in FIGS. 5 and 6, each side of the inner surface of the yoke attachment portion 12 are not completely flat but shaped like a pin cushion projecting toward the tube axis Z. In other words, in a cross section perpendicular to the tube axis X of the yoke attachment portion 12, the inner contour of the yoke attachment portion is not completely rectangular; i.e., all the sides are projected toward the tube axis Z. In this embodiment, each of shorter sides 29 of the inner contour of the yoke attachment portion 12 is a convexity having a peak on the horizontal axis X and each of longer sides 30 is a convexity having a peak on the vertical axis V. When the sides 29 and 30 are convex, to avoid excessive reduction of the thickness of the corners of the yoke attachment portion, each corner has arced surfaces 31 and 27 both inside and outside.

The shape of the inner contour of the yoke attachment portion 12 as described above is determined in accordance with the shape of an electron beam passage region 28 in the yoke attachment portion 12. As a result of detailed analysis of orbits of electron beams in cathode ray tubes of in-line self-convergence type, the following fact was quantitatively confirmed: when a substantially rectangular raster is drawn on the phosphor screen, the electron beam passage region 28 is not completely rectangular but distorted like a pin cushion, i.e., the sides of the outer contour of the electron beam passage region 28 are curved inwardly toward the tube axis Z.

Based on the analysis, according to the present embodiment, the inner contour of the cross section of the yoke attachment portion 12 is formed of curved sides as described above to form a pin-cushion shape similar to the shape of the cross section of the electron beam passage region 28, so that the inner surface of the yoke attachment portion 12 can be as close as possible to the electron beam passage region 28. For example, the distance between the inner surface of the yoke attachment portion 12 and the electron beam passage region 28 is set to about 1 mm.

Figure 7:
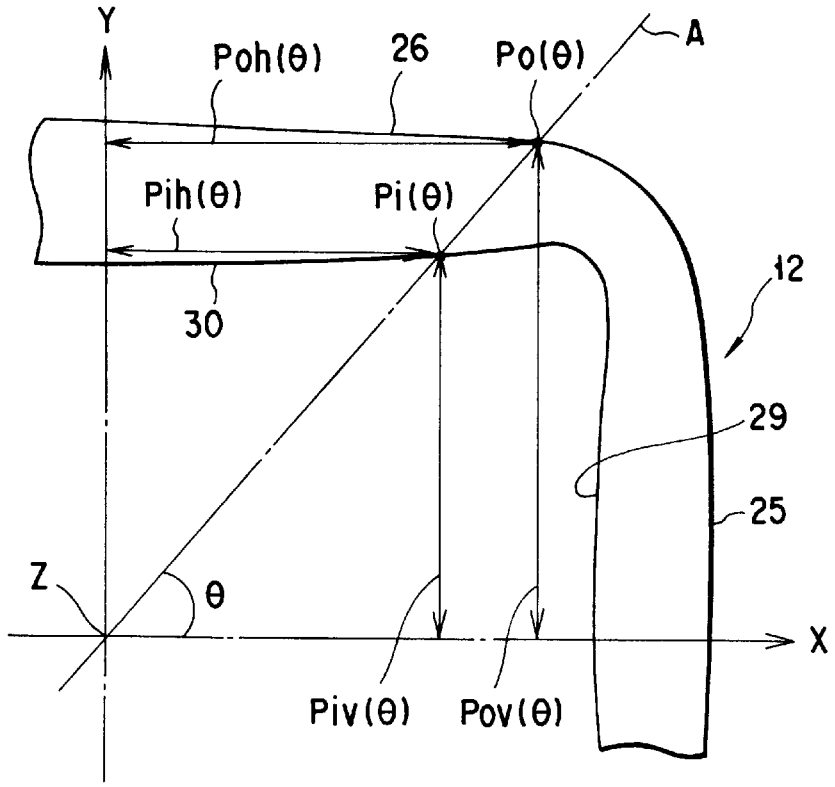

The shape of the inner contour of a cross section of the yoke attachment portion is defined as follows. In a cross section perpendicular to the tube axis Z of the yoke attachment portion 12 as shown in FIG. 7, it is assumed that an intersection of the inner contour of the yoke attachment portion 12 and a line A passing through the tube axis Z and defining an angle θ with the horizontal axis X is represented by Pi(θ), the shortest distance between Pi(θ) and the horizontal axis X is represented by Piv(θ), and the shortest distance between Pi(θ) and the vertical axis Y is represented by Pih(θ). In this case, the inner contour of the yoke attachment portion has a shape such that Piv(θ) is expressed by a non-monotone increasing or decreasing function which has a maximum value ($dPiv(\theta_{0)/d\theta=0}$) at an angle $\theta_0$ ($0<\theta_0<90$), and Pih(θ) is expressed by a non-monotone increasing or decreasing function which has a maximum value (dPih(θ0)/dθ=0) at an angle $\theta_0$ ($0<\theta_0<90$). Thus, the inner surface of the yoke attachment portion 12 has a shape including a convex portion curved toward the tube axis Z with respect to the vertical or horizontal axis.

As described above, in the cross section of the yoke attachment portion 12 of the funnel 4, the outer contour is substantially rectangular and the inner contour having four convex sides curved inwardly toward the tube axis. With this structure, the inner surface of the yoke attachment portion can be close to the electron beam passage region 28 to the possible limit. In addition, the yoke attachment portion 12 can be thick in portions near the horizontal and vertical axes, thereby increasing the strength of the yoke attachment portion. Therefore, the strength against the atmospheric pressure of the vacuum envelope 10 can be increased, and the deflection efficiency of the deflection yoke 11 can be improved to reduce the deflection power.

The table indicated below shows an effect of reducing the vacuum stress obtained by increasing the thickness of the yoke attachment portion 12 in a cathode ray tube which has a neck diameter of 29.1 mm and a maximum deflection angle of 100°.

In the table, "Thickness of the yoke attachment portion" means a thickness along the diagonal axis, horizontal axis or vertical axis on a cross section perpendicular to the tube axis corresponding to the center of deflection, which is generally called a reference line. "Vacuum stress at maximum" means the greatest vacuum stress (calculated value) in all the region of the yoke attachment portion 12. In case of a pyramidal yoke attachment portion, the maximum stress in tensile directions is generated in the corner portions of the yoke attachment portion on a plane nearer to the phosphor screen than the reference line. In the cross section on the reference line, the distances from the tube axis to the outer surface of the yoke attachment portion along the diagonal axis, horizontal axis and vertical axis are 30.4 mm, 27.2 mm and 22.6 mm, respectively. The aspect ratio of the phosphor screen is set to 3:4.

TABLE

| | Thickness of the yoke attachment portion | | | |
|---|---|---|---|---|
| | Diagonal Axis | Horizontal Axis | Vertical Axis | Vacuum stress at maximum |
| Type A | 3.3 mm | 3.3 mm | 3.1 mm | 1523 pis |
| Type B | 3.3 mm | 4.0 mm | 4.0 mm | 1160 pis |
| Type C | 3.3 mm | 6.0 mm | 6.0 mm | 1102 pis |

As clear from the table, the vacuum stress is considerably reduced, as the thickness of the yoke attachment portion along the horizontal and vertical axes is increased. In Type C, as shown in FIGS. 5 and 6, the distance between the inner surface of the yoke attachment portion and the electron beam passage region along the horizontal and vertical axes is reduced to the possible limit, about 1 mm. The shape of the pyramidal yoke attachment portion on a plane perpendicular to the tube axis substantially coincides with the orbit of the electron beams not only in the diagonal direction but also in the horizontal and vertical directions, at any position of the yoke attachment portion along the tube axis direction.

As a result, the vacuum stress at maximum can be as low as 1100 pis and the deflection power can be 22% reduced as compared to the conventional cathode ray tube.

The embodiment as described above provides a cathode ray tube in which the yoke attachment of the funnel has a sufficient glass thickness, even if the yoke attachment portion is pyramidal, and which satisfies the demand for high luminance and high-frequency deflection, by effectively reducing the deflection power, while maintaining sufficient strength against the atmospheric pressure of the vacuum envelope.

The present invention is not limited to the above embodiment but can be modified variously.

Figure 8:
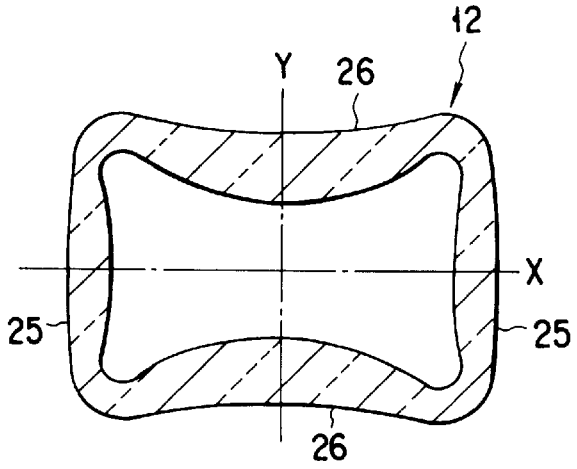
FIG. 8 is a cross-sectional view of a modification of the yoke attachment portion.
Figure 9:
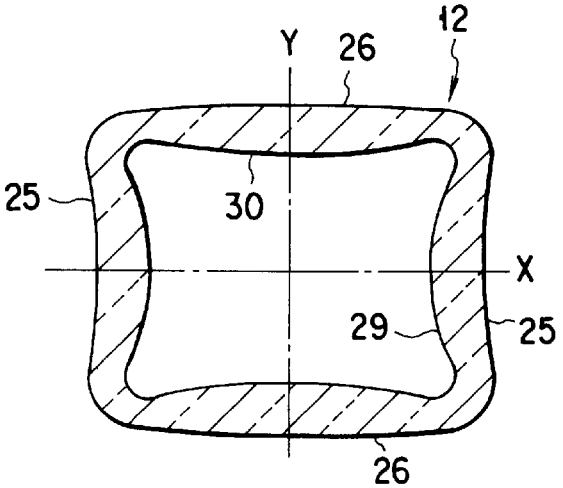
FIG. 9 is a cross-sectional view of another modification of the yoke attachment portion.

According to the above embodiment, the yoke attachment portion 12 has a so-called barrel shape, having a substantially rectangular cross section in which the sides on the outer surface are curved outward with respect to the tube axis. However, the yoke attachment portion may have another shape, for example, as shown in FIG. 8 or 9. More specifically, either outer surfaces 26 along the horizontal axis X of the yoke attachment portion 12 or outer surfaces 25 along the vertical axis Y thereof may be curved inward, so long as the vacuum stress is reduced sufficiently by increasing the glass thickness of the yoke attachment portion, by means of the yoke attachment portion having an inner surface shaped like a pin cushion which substantially coincides with the shape of an electron beam passage region.

In this case, as in the embodiment described above, the outer contour of the yoke attachment portion 12 is defined as follows. In a cross section perpendicular to the tube axis Z of the yoke attachment portion 12 as shown in FIG. 7, it is assumed that an intersection of the outer contour of the yoke attachment portion and a line A passing through the tube axis Z and forming an angle θ with the horizontal axis X is represented by Po(θ), the shortest distance between Po(θ) and the horizontal axis X is represented by Pov(θ), and the shortest distance between Po(θ) and the vertical axis Y is represented by Poh(θ). In this case, the outer contour of the yoke attachment portion has a shape such that Pov(θ) is expressed by a non-monotone increasing or decreasing function which has a maximum value ($dPov(\theta_0)/d\theta=0$) at an angle $\theta_0$ ($0<\theta_0<90$), and Poh(θ) is expressed by a non-monotone increasing or decreasing function which has a maximum value ($dPoh(\theta_{0)/d\theta=}0$) at an angle $\theta_0$ ($0<\theta_0<90$).

In the case where the funnel has the yoke attachment portion 12 of the above structure, the same effect and advantage as those of the aforementioned embodiment can be obtained.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A cathode ray tube comprising:

a vacuum envelope having a face panel including a substantially rectangular effective portion having horizontal and vertical axes which cross at right angles and pass a tube axis, a funnel connected to the face panel, a cylindrical neck connected to a smaller-diameter end of the funnel, and a phosphor screen formed on an inner surface of the effective portion of the face panel, the funnel including a yoke attachment portion extending from the smaller-diameter end connected to the neck toward the face panel;

an electron gun arranged within the neck, for emitting an electron beam to the phosphor screen; and a deflection yoke mounted on outer surfaces of the neck and the yoke attachment portion of the funnel, for deflecting the electron beam emitted from the electron gun along the horizontal and vertical axes so to cause the electron beam to scan the phosphor screen;

at least one cross section of the yoke attachment portion, perpendicular to the tube axis, having a non-circular outer contour which has four line segments divided by the horizontal and vertical axes and, in each of the four line segments, a distance between the tube axis and the outer contour is maximal at a point between a first intersection of the horizontal axis and the outer contour and a second intersection of the vertical axis and the outer contour; and on the at least one cross section, assuming that an intersection of the inner contour of the cross section and a line passing through the tube axis and forming an angle (θ) with the horizontal axis is represented by Pi(θ), as shortest distance between Pi(θ) and the horizontal axis is represented by Piv(θ) and a shortest distance between Pi(θ) and the vertical axis is represented by Pih(θ), the inner contour of the cross section has a shape such that Pih(θ) is expressed by a function which has a minimal value substantially at an angle θ=0°,when the angle (θ) is varied in a range of −90°<0<90°, or Piv(θ) is expressed by a function which has a minimal value substantially at an angle θ=90°. when the angle (θ) is varied in a range of 0°<θ<180°.

2. A cathode ray tube comprising:

a vacuum envelope having a face panel including a substantially rectangular effective portion having horizontal and vertical axes which cross at right angles and pass a tube axis, a funnel connected to the face panel, a cylindrical neck connected to a smaller-diameter end of the funnel, and a phosphor screen formed on an inner surface of the effective portion of the face panel, the funnel including a yoke attachment portion extending from the smaller-diameter end connected to the neck toward the face panel;

an electron gun arranged within the neck, for emitting an electron beam to the phosphor screen; and a deflection yoke mounted on outer surfaces of the neck and the yoke attachment portion of the funnel, for deflecting the electron beam emitted from the electron gun along the horizontal and vertical axes so as cause the electron bean to scan the phosphor screen;

at least one cross section of the yoke attachment portion, perpendicular to the tube axis, having a substantially rectangular outer contour which includes a pair of first opposed sides that traverse the horizontal axis, and a pair of second opposed sides that traverse the vertical axis, and a substantially rectangular inner contour which includes a pair of third opposed sides that traverse the horizontal axis, and a pair of fourth opposed sides that traverse the vertical axis; and at least a part of each of the third and fourth sides of the inner contour being defined by a convexity curved toward the tube axis.

3. A cathode ray tube according to claim 2, wherein each of the third and fourth sides of the inner contour is entirely defined by a convexity curved toward the tube axis.

4. A cathode ray tube according to claim 3, wherein the third and fourth sides of the inner contour are defined by convexities curved toward the tube axis, each having a peak on the horizontal or vertical axis.

5. A cathode ray tube according to claim 2, wherein at least a part of at least one of the first and second opposed sides of the outer contour includes a concavity curved outward from the tube axis.

6. A cathode ray tube according to claim 5, wherein at least one of the first and second opposed sides of the outer contour are defined by concavities curved outward from the tube axis and each having a peak on the horizontal or vertical axis.

* * * * *